US006781547B2

(12) United States Patent
Lee

(10) Patent No.: US 6,781,547 B2
(45) Date of Patent: Aug. 24, 2004

(54) PLANAR INVERTED-F ANTENNA AND APPLICATION SYSTEM THEREOF

(75) Inventor: Chang-Jung Lee, Taoyuan (TW)

(73) Assignee: Accton Technology Corporation (TW)

( * ) Notice: Subject to any disclaimer, the term of this patent is extended or adjusted under 35 U.S.C. 154(b) by 0 days.

(21) Appl. No.: 10/385,743

(22) Filed: Mar. 12, 2003

(65) Prior Publication Data

US 2004/0119643 A1 Jun. 24, 2004

(51) Int. Cl.[7] ..... H01Q 1/38
(52) U.S. Cl. ..... 343/700 MS; 343/702
(58) Field of Search ..... 343/700 MS, 702

(56) References Cited

U.S. PATENT DOCUMENTS 6,404,394 B1 * 6/2002 Hill ..... 343/702
6,597,319 B2 * 7/2003 Meng et al. ..... 343/702
6,646,607 B2 * 11/2003 Usui et al. ..... 343/700 MS

* cited by examiner

*Primary Examiner*—James Vannucci

(57) ABSTRACT

A Planar Inverted-F Antenna (PIFA) and the related application system are disclosed. The PIFA is formed on a base board having a circular hole and a slot, and the PIFA comprises a first radiating conducting line that is formed conformally around the circular hole; a second radiating conducting line that is formed conformally around portion of the slot; and a straight radiating conducting line located between the circular and the slot, wherein one end of the first radiating conducting line is connected to one end of the straight radiating conducting line, and one end of the second radiating conducting line is merged into portion of the outer side of the first radiating conducting line adjacent to the aforementioned end of the first radiating conducting line, and an opening is formed with the straight radiating conducting line and the first radiating conducting line. Moreover, the present invention uses the arrangement of antenna diversity to install two antennas on a base board at the same time, thereby obtaining better antenna performance.

20 Claims, 9 Drawing Sheets x-z plane

PLANAR INVERTED-F ANTENNA AND APPLICATION SYSTEM THEREOF

FIELD OF THE INVENTION

The present invention relates to a planar inverted-F antenna (PIFA) and the application system thereof, and more particularly, to the planar inverted-F antenna formed on a surface of a circuit base board and the application system thereof.

BACKGROUND OF THE INVENTION

With the advances in communication technologies, the applications using communication technologies have also increased significantly, thus making the related products more diversified. Especially, consumers have more demands on advanced functions from communication applications, so that many communication applications with different designs and functions have been continuously appearing in the market, wherein the computer network products with wireless communication functions are the main streams recently. Moreover, with integrated circuit (IC) technologies getting matured, the size of product has been gradually developed toward smallness, thinness, shortness and lightness.

An antenna in the communication products is an element mainly used for radiating or receiving signals. Particularly, the design and study of microstrip antennas or printed antennas are quite important. An antenna is an element used for radiating or receiving electromagnetic wave, and generally, the features of antenna can be known by the parameters of operation frequency, radiation patterns, reflected loss, and antenna gain, etc.

According to different operation requirements, the functions equipped in the communication products are not all the same, and thus there are many varieties of antenna designs used for radiating or receiving signals, such as a rhombic antenna, a turnstile antenna, a triangular microstrip antenna, and an inverted-F antenna, etc. The structure of a conventional inverted-F antenna basically includes a small piece of metal plate installed on a ground plane to be a radiating main body, and a short-circuit line that is added on the edge of the radiating main body and connected to the ground plane, so that the length of antenna is reduced from ½ resonance wavelength to ¼ resonance wavelength, thus achieving the effect of miniaturizing the antenna size.

Referring to FIG. 1A and FIG. 1B, FIG. 1A and FIG. 1B are 3-D schematic diagrams respectively showing two conventional planar inverted-F antennas. Such as shown in FIG. 1A, one conventional planar inverted-F antenna is composed of a ground plane 10, a radiating metal line 20, a short-circuit line 22 and a TEM transmission line 30, wherein one end of the short-circuit line 22 is vertically connected to one end of the radiating metal line 20, and the other end of the short-circuit line 22 is vertically connected to the ground plane 10. The TEM transmission line 30 is composed of an inner conductor 34 and an outer conductor 32, wherein the inner conductor 34 is vertically connected to the radiating metal line 20 for feeding signals. Further, such as shown in FIG. 1B, in the other conventional planar inverted-F antenna, a radiating metal plate 40 and a short-circuit plate 42 are used to replace the radiating metal line 20 and the short-circuit line 22. However, those two conventional planar inverted-F antennas are formed three-dimensionally, which means that they have to occupy the space resulted from such as the height of the short-circuit line 22 or the height of the short-circuit plate 42. Therefore, the aforementioned space taken by the conventional planar inverted-F antennas becomes a very difficult issue for designing an ultra-thin product.

Hence, there is an urgent need to develop a modified planar inverted-F antenna for satisfactorily meeting the antenna requirements of small size, small thickness, high gain, broad bandwidth, simple design, and low cost, etc., thereby overcoming the disadvantages of the conventional planar inverted-F antennas.

SUMMARY OF THE INVENTION

In view of the invention background described above, in the wireless communication products, an antenna plays an important part, since the antenna has great influence on the performance of communication performance. Therefore, the design of the antenna is developed towards the aspects of small size, low cost, high gain and easy practice. Since the conventional planar inverted-F antennas occupy certain space in height, they fail to effectively satisfy the requirements of communication products, especially for the products having ultra-small thickness.

It is the principal objective of the present invention to provide a planar inverted-F antenna and the application system thereof, thereby providing the antenna with ultra-small thinness, small size, good quality and low price, wherein the antenna of the present invention also has excellent antenna features of broad bandwidth, low antenna loss and good radiation patterns, etc., and can be easily matched with a circuit base board for fabricating a communication product, thereby lowering the cost needed for integrating with the circuit and enhancing the product stability, thus having high industrial application value.

It is the other objective of the present invention to provide a planar inverted-F antenna and the application system thereof, for obtaining better antenna performance by simultaneously installing two planar inverted-F antennas on a base board via the arrangement of antenna diversity.

In accordance with the aforementioned objectives of the present invention, the present invention provides a planar inverted-F antenna, wherein the planar inverted-F antenna comprises: a base board at least having a first surface and a second surface, wherein the first surface and the second surface are located respectively on two opposite sides of the base board; a circular hole penetrating the base board, wherein the circular hole has a first radius; a slot penetrating the base board, the slot having a first straight side and a second straight side that are parallel to each other, wherein both ends of the first straight side and both ends of the second straight side are respectively connected to a first arc and a second arc that are mirror-reflected to each other, and the convex surface of the first arc and the convex surface of the second arc face outwards, the first arc and the second arc being formed with a second radius; a first radiating conducting line located on the first surface of the base board, and are formed conformally around portion of the circular hole, wherein the first radiating conducting line has an inner side located near the circular hole, and an outer side located farther away from the circular hole; a second radiating conducting line, wherein the second radiating conducting line is located on the first surface, and is formed conformally around portion of the first arc and portion of the first straight side; and a straight radiating conducting line located between the first arc and the circular hole, wherein one end of the first radiating conducting line adjacent to the slot is connected to one end of the straight radiating conducting-line, and one end of the second radiating conducting line adjacent to the first arc is merged into portion of the outer side adjacent to the aforementioned end of the first radiating conducting line, the straight radiating conducting line and the first radiating conducting line forming an opening, the second side of the slot being located at the same side of the opening, the first side of the slot being located at the side different from the opening.

Further, the present invention provides a planar inverted-F antenna application system, the application system comprising: a base board at least having a first surface and a second surface, wherein the first surface and the second surface are located respectively on two opposite sides of the base board, a first planar inverted-F antenna formed on the first surface of the base board, wherein a straight conducting line of the first planar inverted-F antenna and the radiating conducting line surrounding portion of a circular hole are combined to form a first opening; and a second planar inverted-F antenna formed on the first surface of the base board, wherein a straight conducting line of the second planar inverted-F antenna and the radiating conducting line surrounding portion of a circular hole are combined to form a second opening. The first planar inverted-F antenna is parallel to the second planar inverted-F antenna, wherein the opening direction of the first opening can be the same as, opposite to or reversed to the opening direction of the second opening.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

The planar inverted-F antenna of the present invention and its application system can be entirely formed on a base board, and do not occupy the space above or below the base board, so that the shortcomings of the conventional planar inverted-F antennas can be overcome, thereby effectively satisfying the requirement of communication products, especially for the products having ultra-thin thickness.

Figure 1A:
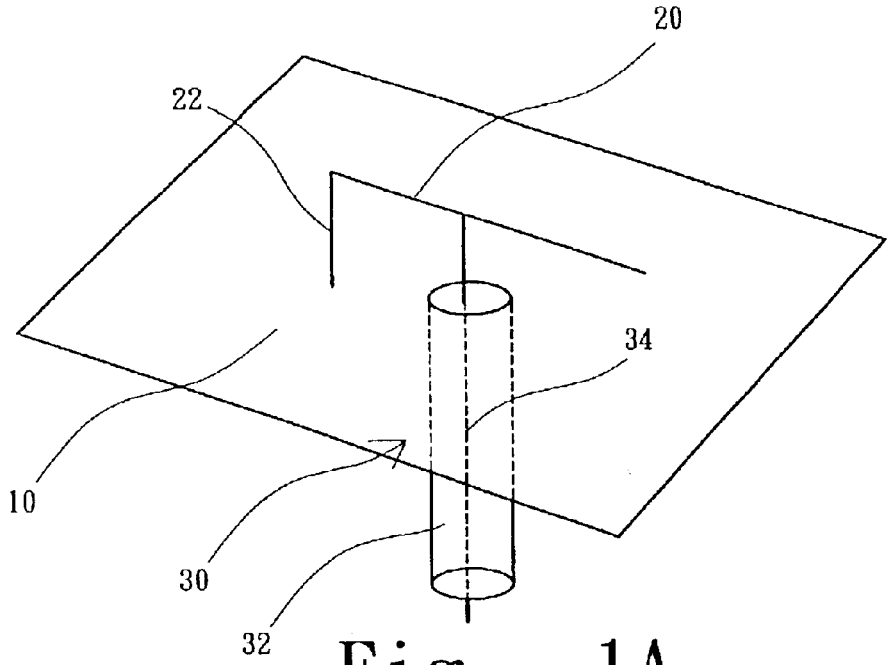
Fig. 1A (Prior Art)
FIG. 1A and FIG. 1B are 3-D schematic diagrams respectively showing two conventional planar inverted-F antennas.
Figure 1B:
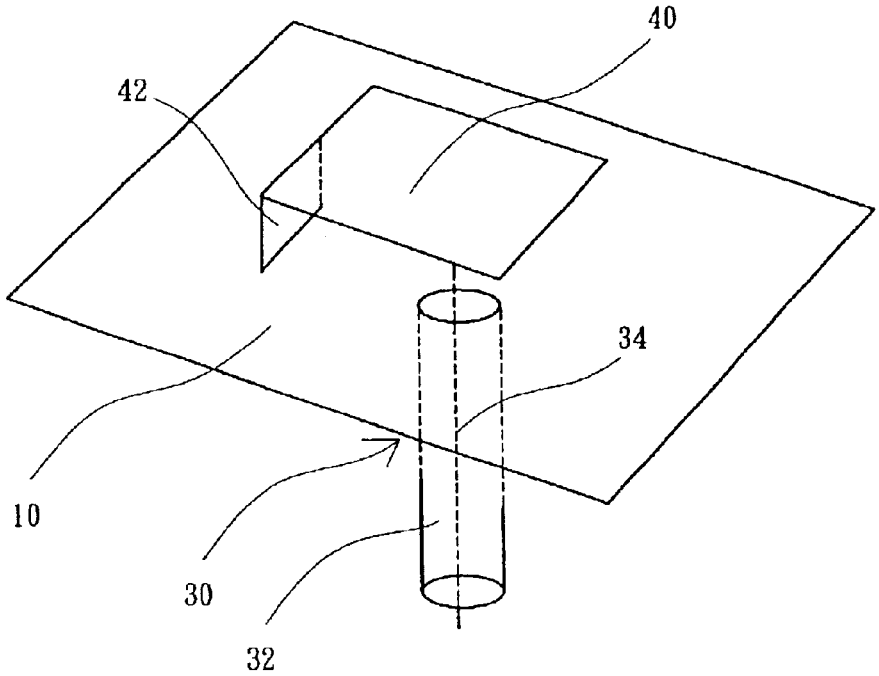
Fig. 1B(Prior Art)
Figure 2:
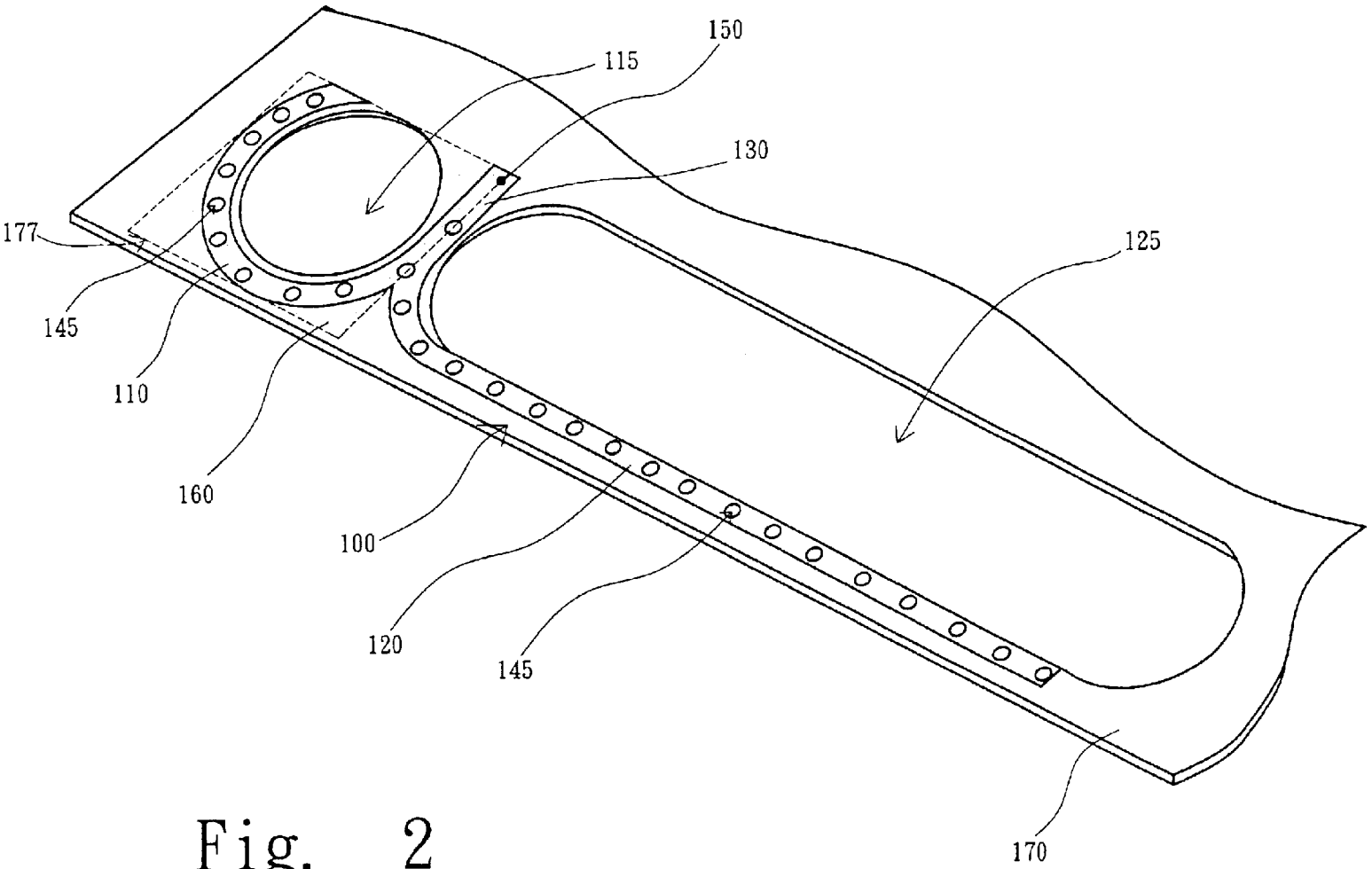
FIG. 2 is a 3-D schematic diagram showing a planar inverted-F antenna, according to a preferred embodiment of the present invention.

Referring to FIG. 2, FIG. 2 is a 3-D schematic diagram showing a planar inverted-F antenna, according to a preferred embodiment of the present invention. Such as shown in FIG. 2, a planar inverted-F antenna 100 is formed on an upper surface of a base board 170, and the planar inverted-F antenna 100 comprises: a circular hole 115, a slot 125, radiating conducting lines 110 and 120, a straight radiating conducting line 130, wherein one end of the straight radiating conducting line 130 not connected to the radiating conducting line 110 has a feeding point 150. A plurality of through holes 145 penetrating the base board 170 can be formed evenly on the radiating conducting line 110 and the radiating conducting line 120, and if desired, the through holes 145 can be also formed evenly on the straight radiating conducting line 130. It is worthy to be noted that the application of the circular hole 115, the slot 125 and the through holes 145 can effectively increase the operation bandwidth and gain of the antenna. Further, the base board 170 can be such as a printed circuit board made of fiberglass material (FR4), and a ground plane 177 made of electrically-conductive material can be formed on a lower surface of the base board 170, wherein the ground plane 177 can be located exactly under the radiating conducting line 110 and portion of the straight conducting line 130 (such as one half of the straight conducting line 130). However, the location of the ground plane 177 of the preferred embodiment of the present invention can be different in accordance with the actual needs, so that the present invention is not limited thereto.

Figure 3:
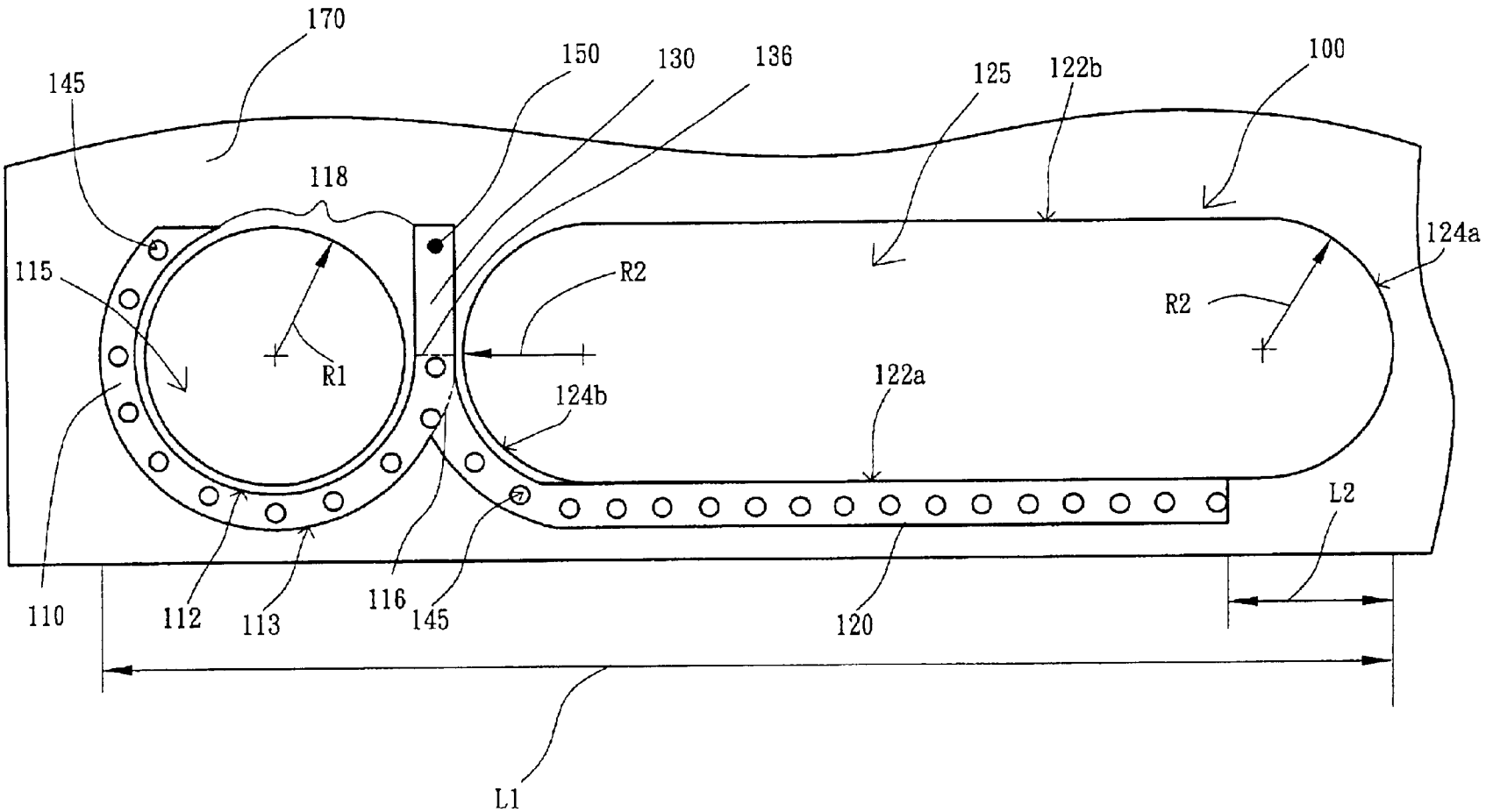
FIG. 3 is a schematic diagram showing the top view of the planar inverted-F antenna, according to the preferred embodiment of the present invention.

Referring to FIG. 3, FIG. 3 is a schematic diagram showing the top view of the planar inverted-F antenna, according to the preferred embodiment of the present invention. Such as shown in FIG. 3, the circular hole 115 and the slot 125 penetrates the base board 170 and is formed with a radius R1. The slot 125 has two parallel straight sides 122*a* and 122*b*, and both ends of the straight side 122*a* and both ends of the straight side 122*b* are respectively connected arcs 124*a* and 124*b* that are mirror-reflected to each other, wherein the convex surface of the arc 124*a* and the convex surface of the arc 124*b* face outwards, and are such as semicircles formed with a radius R2. The radiating conducting line 110 is formed conformally around portion of circular hole 115, and has an inner side 112 near the circular hole 115, and an outer side 113 located farther away from the circular hole 115. The radiating conducting line 110 and the straight radiating conducting line 130 are combined to form an opening 118, wherein the straight side 122*b* of the slot 125 is located at the same side of the opening 118, and the straight side 122*a* thereof is located on the other side of the opening 118. The shape of the inner side 112 of the radiating conducting line 110 can be an arc having an angle greater than about 180 degrees (such as 247.5 degrees), wherein the angle is measured from one end (shown by a dotted line 136) of the inner side 112 of the radiating conducting line 110 near the slot 125.

Please continuously refer to FIG. 3. The radiating conducting line 120 is formed conformally around portion of the arc 124*b* and portion of the straight side 122*a*. The straight radiating conducting line 130 is located between the arc 124*b* and the circular hole 115, wherein one end (shown by the dotted line 136) of the radiating conducting line 110 adjacent to the slot 125 is connected to one end of the straight radiating conducting line 130, and one end of the radiating conducting line 120 adjacent to the arc 124*b* is merged into portion of the outer side 113 (shown by a dotted line 116) adjacent to the aforementioned end of the radiating conducting line 110. There is a side distance L2 between the other end of the radiating conducting line 120 and the top of the arc 124*a* of the slot 125, wherein the magnitude of the side distance L2 is determined in accordance with the material forming the base board 170 and the material forming the radiating conducting lines.

Moreover, in the present preferred embodiment, the antenna total length L1 can be for example about 26.1 mm; the length of the radius R1 can be equal to the length of the radius R2 as for example about 2 mm; and the widths of the radiating conducting line 110, the radiating conducting line 120 and the straight radiating conducting line 130 can be the same as for example about 0.3 mm to about 1 mm. However, the aforementioned degrees of arcs, radiuses, lengths, widths and materials are just stated as examples for explanation, so that the present invention is not limited thereto.

Figure 4:
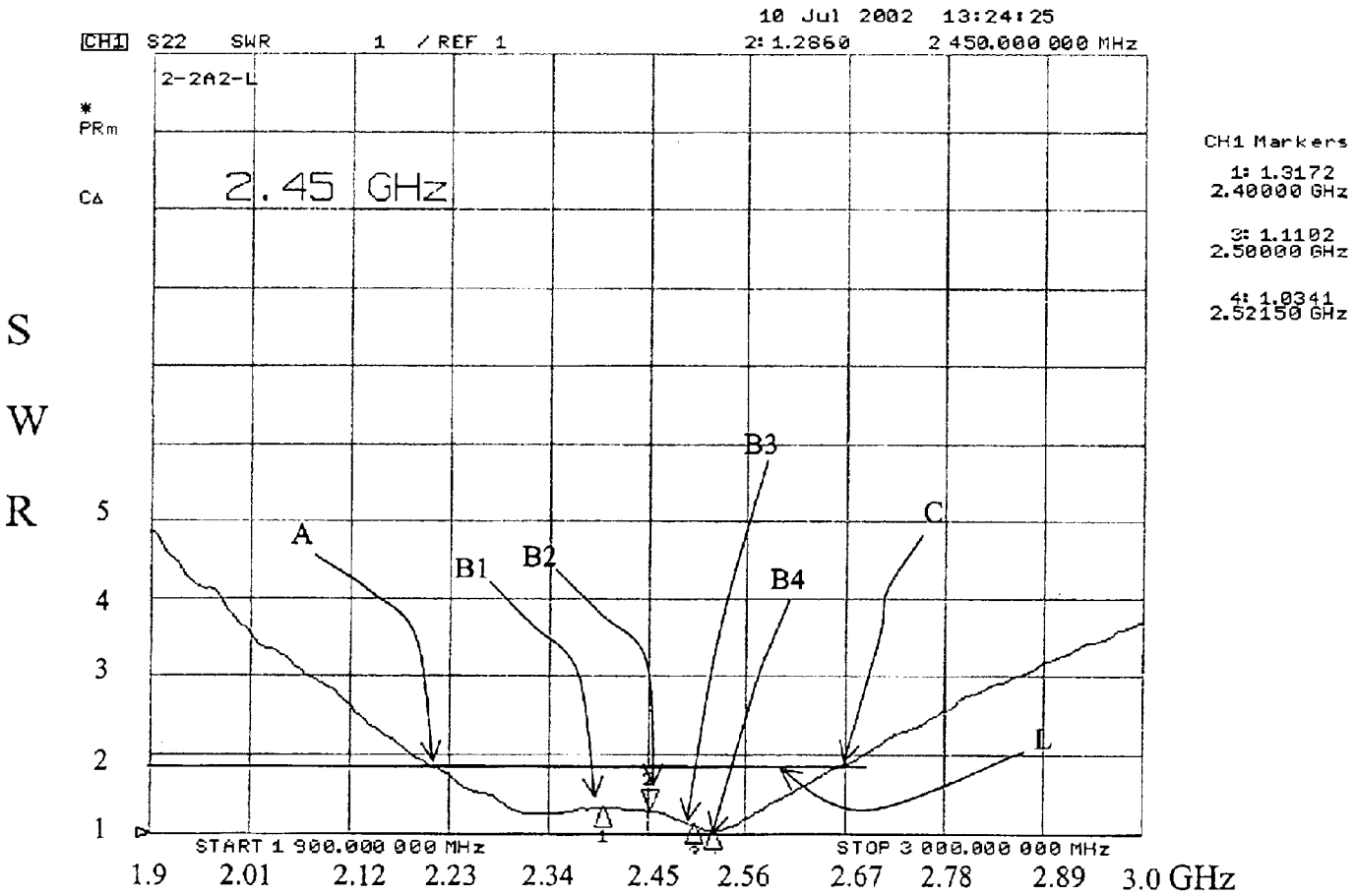
FIG. 4 is a diagram showing the measured result of S.W.R. (Standing Wave Ratio) vs. frequency for the planar inverted-F antenna of the preferred embodiment of the present invention.

After actual measurements, the planar inverted-F antenna of the preferred embodiment of the present invention is proved to have excellent antenna features. Referring FIG. 4, FIG. 4 is a diagram showing the measured result of S.W.R. (Standing Wave Ratio) vs. frequency for the planar inverted-F antenna of the preferred embodiment of the present invention, wherein when the antenna is operated at about 2.4 GHz (such as point B1), the S.W.R is about 1:1.3172; when the antenna is operated at about 2.45 GHz (such as point B2), the S.W.R is about 1:1.3; when the antenna is operated at about 2.5 GHz (such as point B3), the S.W.R is about 1:1.1102; and when the antenna is operated at about 2.52 GHz (such as point B4), the S.W.R is about 1:1.0341. Therefore, if line L of S.W.R equaling to about 1:1.8 is used as reference, the operation frequency at point A is about 2.22 GHz, and the operation frequency at point C is about 2.67 GHZ. Hence, when the planar inverted-F antenna of the preferred embodiment of the present invention is operated at about 2.45 GHz, the operation bandwidth thereof can be about 450 MHz, and the operation bandwidth obtained can effectively satisfy the requirements of design.

Figure 5A:
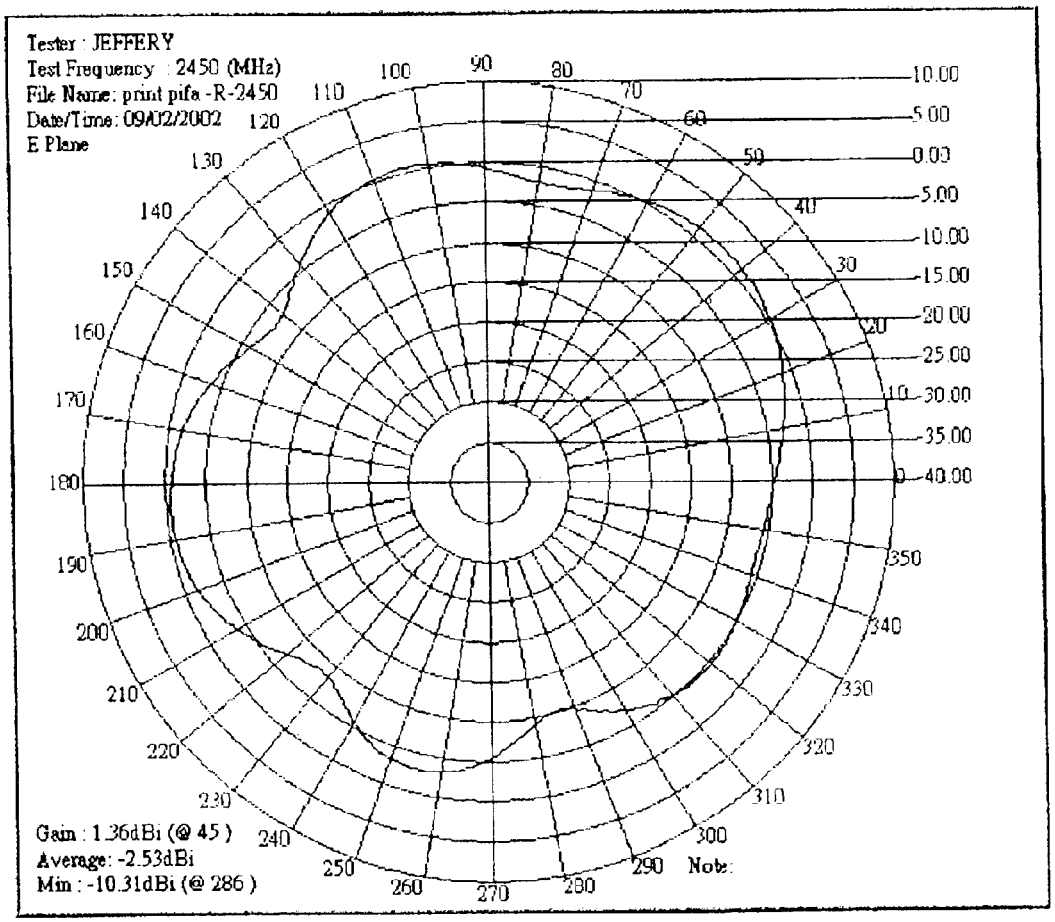
FIG. 5A is a diagram showing a measured radiation pattern in y-z plane when the planar inverted-F antenna of the preferred embodiment of the present invention is operated at 2.45 GHz.
Figure 5B:
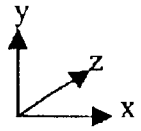
FIG. 5B is a diagram showing a measured radiation pattern in x-z plane when the planar inverted-F antenna of the preferred embodiment of the present invention is operated at 2.45 GHz.
Figure 5B:
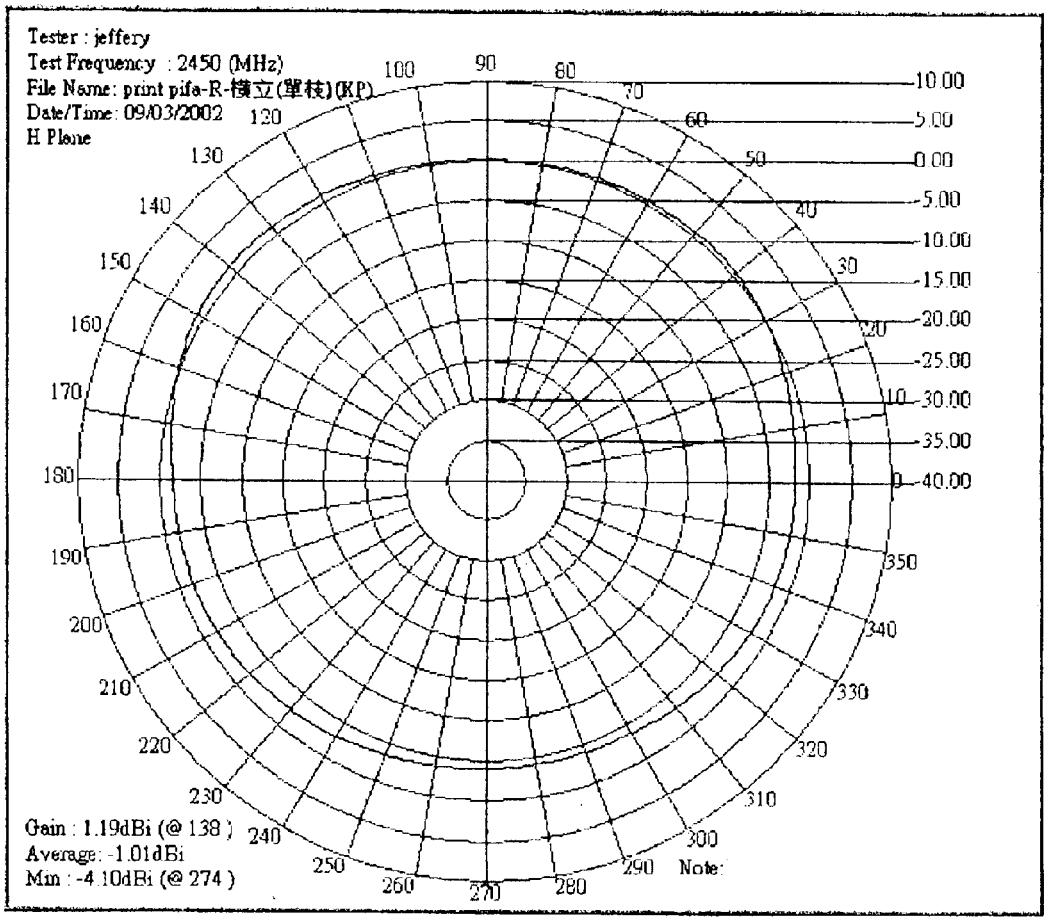

Referring FIG. 5A and FIG. 5B, FIG. 5A is a diagram showing a measured radiation pattern in y-z plane, and FIG. 5B is a diagram showing a measured radiation pattern in x-z plane, when the planar inverted-F antenna of the preferred embodiment of the present invention is operated at 2.45 GHz. It is known from FIG. 5B that a preferred embodiment of the present invention has an omni-directional antenna radiation pattern in x-z plane, and the radiation pattern in y-z plane as shown in FIG. 5A is also quite excellent.

Figure 6A:
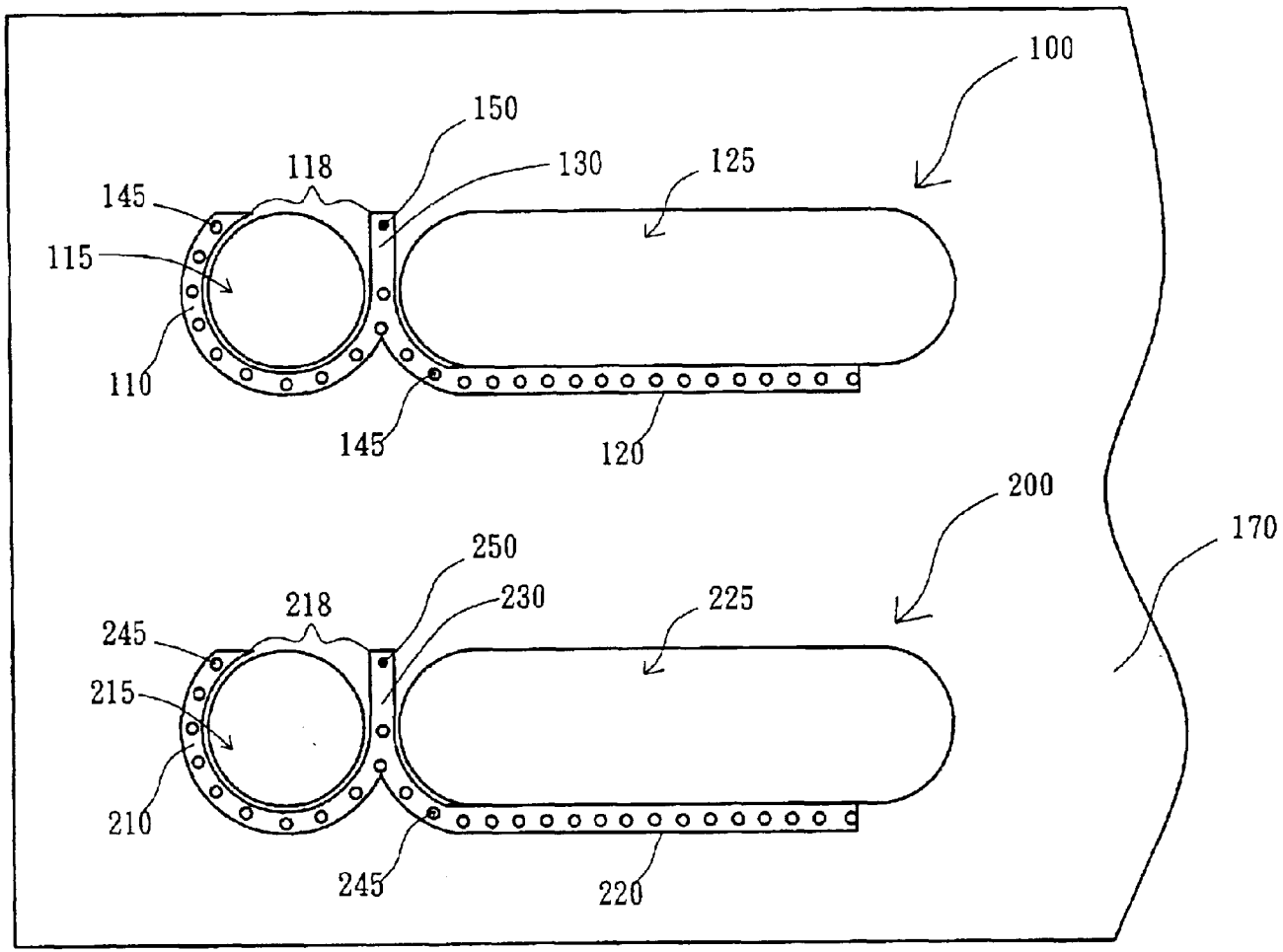
FIG. 6A, FIG. 6B and FIG. 6C are schematic diagrams respectively showing the antenna diversity arrangements of the planar inverted-F antennas, according to the preferred embodiment of the present invention.
Figure 6B:
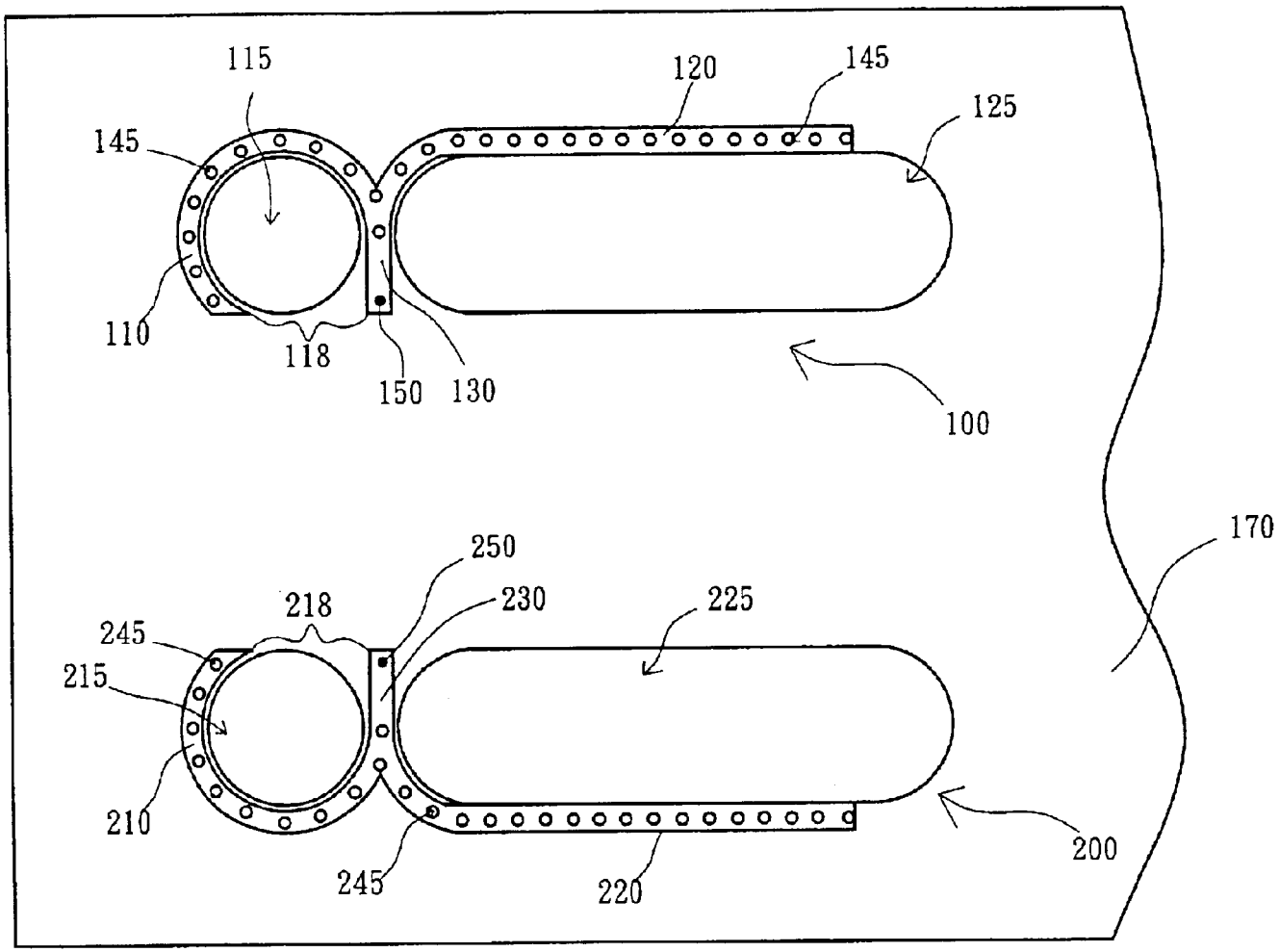
Figure 6C:
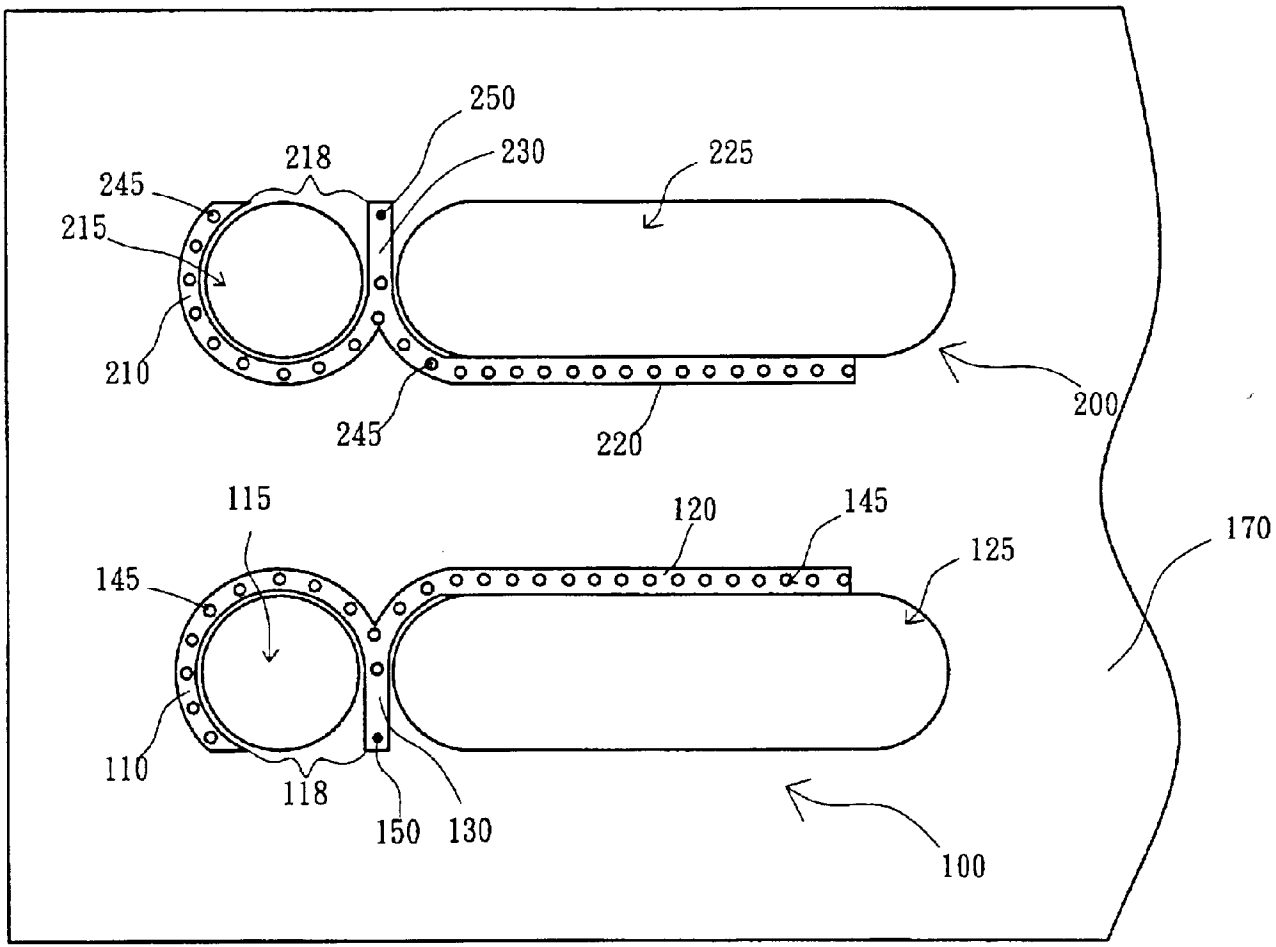

Further, the application system of the planar inverted-F antenna of the preferred embodiment of the present invention can utilize the arrangement of the antenna diversity to obtain better antenna performance. Referring to FIG. 6A, FIG. 6B and FIG. 6C, FIG. 6A, FIG. 6B and FIG. 6C are schematic diagrams respectively showing the antenna diversity arrangements of the planar inverted-F antenna, according to the preferred embodiment of the present invention, wherein a planar inverted-F antenna 200 is formed simultaneously with the planar inverted-F antenna 100 on the base board 170, and the planar inverted-F antenna 200 is parallel and identical to the planar inverted-F antenna 100 in size and shape. Just as described above, similarly, the planar inverted-F antenna 200 comprises: a circular hole 215, a slot 225, radiating conducting lines 210 and 220, and a straight radiating conducting line 230, wherein one end of the straight radiating conducting line 230 not connected to the radiating conducting line 210 has a feeding point 250. A plurality of through holes 245 penetrating the base board 170 can be formed evenly on the radiating conducting line 210 and the radiating conducting line 220. In the planar inverted-F antenna 100, the straight radiating conducting line 130 and the radiating conducting line 110 are combined to form an opening 118; and in the planar inverted-F antenna 200, the straight radiating conducting line 230 and the radiating conducting line 210 are combined to form an opening 218. Such as shown in FIG. 6A, the opening direction of the opening 118 can be the same as the opening direction of the opening 218; such as shown in FIG. 6B, the opening direction of the opening 118 can be opposite to the opening direction of the opening 218; and such as shown in FIG. 6*c*, the opening direction of the opening 118 can be reversed to the opening direction of the opening 218. The purpose of using two planar inverted-F antennas at the same time is to substitute one planar inverted-F antenna with the other planar inverted-F antenna, when the one planar inverted-F antenna is poor in transmitting signals. Meanwhile, via the aforementioned various arrangements of the opening directions, the antenna features of the preferred embodiment of the present invention, such as radiation patterns, etc., can be further promoted.

The advantage of the present invention is to provide a planar inverted-F antenna and the application system thereof The antenna of the present invention has the features of ultra-small thickness, low profile, broad bandwidth, small loss and good radiation patterns, and further can be easily matched with a circuit base board for fabricating a communication product, thus lowering the cost needed for integrating with the circuit and enhancing the product stability, so that the present invention has high industrial application value.

The other advantage of the present invention is to provide a planar inverted-F antenna and the application system thereof, wherein the arrangement of antenna diversity can be used to obtain better antenna performance.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structures.

What is claimed is:

1. A planar inverted-F antenna (PIFA), comprising:

a base board at least having a first surface and a second surface, wherein said first surface and said second surface are located on two opposite sides of said base board, said base board having:

a circular hole, wherein said circular hole has a first radius and penetrates said base board; and a slot penetrating said base board, said slot having a first straight side and a second straight side that are parallel to each other, wherein both ends of said first straight side and both ends of said second straight side are respectively connected to a first arc and a second arc that are mirror-reflected to each other, and the convex surface of said first arc and the convex surface of said second arc face outwards, said first arc and said second arc being formed with a second radius;

a first radiating conducting line having an inner side and an outer side, wherein said inner side and said outer side are located on said first surface, and are formed conformally around portion of said circular hole;

a second radiating conducting line, wherein said second radiating conducting line is located on said first surface, and is formed conformally around portion of said first arc and portion of said first straight side; and a straight radiating conducting line located between said first arc and said circular hole, wherein one end of said straight radiating conducting line is connected simultaneously to one end of said first radiating conducting line adjacent to said slot and one end of said second radiating conducting line adjacent to said first arc, said straight radiating conducting line and said first radiating conducting line forming an opening located at the same side of the other end of said straight radiating conducting line.

2. The planar inverted-F antenna of claim 1, comprising a plurality of through holes penetrating said base board, wherein said plurality of through holes are evenly distributed on said first radiating conducting line and said second radiating conducting line.

3. The planar inverted-F antenna of claim 1, having a side distance located between the other end of said second radiating conducting line and the top of said second arc of said slot.

4. The planar inverted-F antenna of claim 1, comprising a feeding point located on said other end of said straight radiating conducting line.

5. The planar inverted-F antenna of claim 1, comprising a ground plane that is located on said second surface of said base board and exactly under said first radiating conducting line.

6. The planar inverted-F antenna of claim 1, wherein said first arc and said second arc of said slot are two arcs of semicircle.

7. The planar inverted-F antenna of claim 1, wherein said second radiating conducting line having a portion adjacent to said first arc surrounds one half of said first arc of said slot.

8. The planar inverted-F antenna of claim 1, wherein said inner side of said first radiating conducting line is an arc shape having an angle greater than 180 degrees from said one end of said first radiating conducting line adjacent to said slot.

9. The planar inverted-F antenna of claim 1, wherein said first radius and said second radius are the same in length.

10. The planar inverted-F antenna of claim 1, wherein said first radiating conducting line, said second radiating conducting line and said straight radiating conducting line are made of metal lines.

11. The planar inverted-F antenna of claim 1, wherein said first radiating conducting line, said second radiating conducting line and said straight radiating conducting line are all the same in width.

12. The planar inverted-F antenna of claim 1, wherein said base board is made of fiberglass (FR4).

13. The planar inverted-F antenna of claim 1, wherein said base board is a printed circuit board.

14. A planar inverted-F antenna application system, comprising:

a base board at least having a first surface and a second surface, wherein said first surface and said second surface are located on two opposite sides of said base board, said base board having:

a first circular hole penetrating said base board;

a first slot penetrating said base board, said first slot having a first straight side and a second straight side that are parallel to each other, wherein both ends of said first straight side and both ends of said second straight side are respectively connected to a first arc and a second arc that are mirror-reflected to each other, and the convex surface of said first arc and the convex surface of said second arc face outwards;

a second circular hole penetrating said base board; and a second slot penetrating said base board, said second slot having a third straight side and a fourth straight side that are parallel to each other, wherein both ends of said third straight side and both ends of said fourth straight side are respectively connected to a third arc and a fourth arc that are mirror-reflected to each other, and the convex surface of said third arc and the convex surface of said fourth arc face outwards;

a first planar inverted-F antenna formed on said first surface of said base board, said first planer inverted-F antenna comprising:

a first radiating conducting line having a first inner side and a first outer side, wherein said first inner side and said first outer side are located on said first surface, and are formed conformally around portion of said first circular hole;

a second radiating conducting line, wherein said second radiating conducting line is located on said first surface, and is formed conformally around portion of said first arc and portion of said first straight side; and a first straight radiating conducting line located between said first arc and said first circular hole, wherein one end of said first straight radiating conducting line is connected simultaneously to one end of said first radiating conducting line adjacent to said first slot and one end of said second radiating conducting line adjacent to said first arc, said first straight radiating conducting line and said first radiating conducting line forming a first opening located at the same side of the other end of said first straight radiating conducting line; and a second planar inverted-F antenna formed on said first surface of said base board, said second planer inverted-F antenna comprising:

a third radiating conducting line having a second inner side and a second outer side, wherein said second inner side and said second outer side are located on said first surface, and are formed conformally around portion of said second circular hole;

a fourth radiating conducting line, wherein said fourth radiating conducting line is located on said first surface, and is formed conformally around portion of said third arc and portion of said third straight side; and a second straight radiating conducting line located between said third arc and said second circular hole, wherein one end of said second straight radiating conducting line is connected simultaneously to one end of said third radiating conducting line adjacent to said second slot and one end of said fourth radiating conducting line adjacent to said third arc, said second straight radiating conducting line and said third radiating conducting line forming a second opening located at the same side of the other end of said second straight radiating conducting line.

15. The planar inverted-F antenna application system of claim 14, wherein said first planar inverted-F antenna and said second planar inverted-F antenna are identical in shape and size.

16. The planar inverted-F antenna application system of claim 14, wherein said first planar inverted-F antenna is parallel to said second planar inverted-F antenna, and the opening direction of said first opening is opposite to the opening direction of said second opening.

17. The planar inverted-F antenna application system of claim 14, wherein said first planar inverted-F antenna is parallel to said second planar inverted-F antenna, and the opening direction of said first opening is the same as the opening direction of said second opening.

18. The planar inverted-F antenna application system of claim 14, wherein said first planar inverted-F antenna is parallel to said second planar inverted-F antenna, and the opening direction of said first opening is reversed to the opening direction of said second opening.

19. The planar inverted-F antenna application system of claim 14, comprising a ground plane located on said second surface of said base board, wherein said ground plane is located exactly under said first radiating conducting line and said third radiating conducting line.

20. The planar inverted-F antenna application system of claim 14, comprising a plurality of through holes penetrating said base board, wherein said plurality of through holes are evenly distributed on said first radiating conducting line, said second radiating conducting line, said third radiating conducting line and said fourth radiating conducting line.

* * * * *